US010191406B2

(12) United States Patent
Yamaguchi et al.

(10) Patent No.: US 10,191,406 B2
(45) Date of Patent: Jan. 29, 2019

(54) ROTATABLE MEMBER AND ELECTROPHOTOGRAPHIC IMAGE FORMING APPARATUS INCLUDING THE ROTATABLE MEMBER

(71) Applicant: CANON KABUSHIKI KAISHA, Tokyo (JP)

(72) Inventors: Koji Yamaguchi, Numazu (JP); Fumito Nonaka, Mishima (JP); Hiroomi Matsuzaki, Mishima (JP); Makoto Hayashida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/935,440

(22) Filed: Mar. 26, 2018

(65) Prior Publication Data

US 2018/0292766 A1 Oct. 11, 2018

(30) Foreign Application Priority Data

Apr. 7, 2017 (JP) ..... 2017-076570

(51) Int. Cl.
*G03G 15/02* (2006.01)
*G03G 15/08* (2006.01)

(52) U.S. Cl.
CPC ..... *G03G 15/0233* (2013.01); *G03G 15/0808* (2013.01); *G03G 2215/021* (2013.01)

(58) Field of Classification Search
USPC ..... 399/107, 110, 111, 114–117, 119, 159, 399/167, 168, 174, 176
See application file for complete search history.

(56) References Cited

U.S. PATENT DOCUMENTS

| | | | | |
|---|---|---|---|---|
| 7,162,181 | B2 | 1/2007 | Maeshima et al. | |
| 9,500,977 | B2 | 11/2016 | Matsuzaki et al. | |
| 2005/0115043 | A1 | 6/2005 | Maeshima et al. | |
| 2011/0079952 | A1* | 4/2011 | Ono | B41J 13/03 271/10.09 |
| 2015/0277265 | A1 | 10/2015 | Matsuzaki et al. | |
| 2017/0219962 | A1 | 8/2017 | Sasaki et al. | |
| 2017/0371263 | A1 | 12/2017 | Hayashida et al. | |
| 2017/0371264 | A1 | 12/2017 | Nonaka et al. | |

FOREIGN PATENT DOCUMENTS

| | | | |
|---|---|---|---|
| JP | 2005164756 | A | 6/2005 |
| JP | 2011136833 | A | 7/2011 |
| JP | 2013103234 | A | 5/2013 |
| JP | 2015113229 | A | 6/2015 |
| JP | 2015197145 | A | 11/2015 |

OTHER PUBLICATIONS

Copending, unpublished U.S. Appl. No. 15/947,109, to Fumito Nonaka, filed Apr. 6, 2018.

* cited by examiner

*Primary Examiner* — Hoan Tran
(74) *Attorney, Agent, or Firm* — Venable LLP

(57) ABSTRACT

A rotatable member for use with a rotatable driving member provided in a process cartridge or an electrophotographic image forming apparatus includes a hollow cylindrical rotation shaft engageable with the rotatable driving member. The rotation shaft includes a seam extending from one end to the other end thereof in an axial direction thereof. The rotation shaft includes a transmitting surface engageable with the driving member and configured to receive a driving force for rotating the rotation shaft about the axial direction. The transmitting surface is twisted or inclined with respect to the axial direction.

20 Claims, 7 Drawing Sheets

(a)

(b)

ROTATABLE MEMBER AND ELECTROPHOTOGRAPHIC IMAGE FORMING APPARATUS INCLUDING THE ROTATABLE MEMBER

FIELD OF THE INVENTION AND RELATED ART

The present invention relates to a voltage applying device for applying a voltage to a member-to-be-charged such as an electrophotographic photosensitive member or a dielectric member, a process cartridge including the voltage applying device and detachably mountable to an apparatus main assembly of an electrophotographic image forming apparatus and the electrophotographic image forming apparatus including the voltage applying device, and relates to a rotatable member for use with a rotatable driving member provided in the process cartridge or the electrophotographic image forming apparatus.

The electrophotographic image forming apparatus forms an image on a recording medium (material) with use of an electrophotographic image forming type. As examples of the electrophotographic image forming apparatus, for example, an electrophotographic copying machine, an electrophotographic printer (e.g., a laser beam printer, an LED printer, etc.), a facsimile machine, a word processor and the like are included. The apparatus main assembly is an image forming apparatus portion excluding the process cartridge from the electrophotographic image forming apparatus. The recording medium is a material on which the image is formed by the electrophotographic image forming apparatus, and for example, paper, OHT sheet, cloth and the like are included. Further, an image display member of an image display apparatus such as an electronic blackboard (white board) is also included.

Conventionally, in the electrophotographic image forming apparatus, a process cartridge type in which a photosensitive member and a process means actable on the photosensitive member are integrally assembled into a cartridge (unit) and the cartridge is detachably mountable to an apparatus main assembly of the image forming apparatus is employed. According to this process cartridge type, maintenance of the image forming apparatus can be carried out by a user himself (herself) without relying on a service person, so that operativity was able to be remarkably improved. Therefore, this process cartridge type has been widely used in the image forming apparatus.

The process cartridge includes a photosensitive drum (electrophotographic photosensitive drum) which is an image bearing member as disclosed in Japanese Laid-Open Patent Application (JP-A) 2005-164756, which also discloses a constitution including a charging roller for imparting electric charges to the photosensitive drum, a developing roller for supplying a developer (hereinafter referred to as "toner") and a cleaning means for removing the toner remaining on a photosensitive drum surface without being transferred.

The developing roller is rotated by receiving drive (driving force) from the apparatus main assembly and is contacted to the photosensitive drum, and thus continuously supplies the toner from a developer accommodating portion to the photosensitive drum surface. As rollers of the process cartridge, a plurality of rollers such as a developing roller and a charging roller are used, but any roller includes a solid metal shaft as a rotation shaft in general.

On the other hand, in order to reduce a cost, JP-A 2015-197145 discloses a constitution in which a cylindrical shaft manufactured by press work and including a seamed portion (hereinafter referred to as a "seam") over an entire region with respect to an axial direction is used as a rotation shaft of a roller.

JP-A 2013-103234 discloses a constitution in which a gear which is a driving member is attached to a shaft end of a pressed rotation shaft and then the rotation shaft is rotated.

SUMMARY OF THE INVENTION

The present invention is further development of the above-described conventional constitutions.

A principal object of the present invention is to determine positions of a project and a driving member with respect to an axial direction of the rotation shaft with reliability or to suppress a positional fluctuation of the rotation shaft with respect to the axial direction of the rotation shaft by accurately determining the positions of the rotation shaft and the driving member with respect to the axial direction of the rotation shaft and thereby to suppress a rotational fluctuation of the rotation shaft.

According to an aspect of the present invention, there is provided a rotatable member for use with a rotatable driving member provided in a process cartridge or an electrophotographic image forming apparatus, the rotatable member comprising: a hollow cylindrical rotation shaft engageable with the rotatable driving member, wherein the rotation shaft includes a seam extending from one end to the other end thereof in an axial direction thereof, wherein the rotation shaft includes a transmitting surface engageable with the driving member and configured to receive a driving force for rotating the rotation shaft about the axial direction, and wherein the transmitting surface is twisted or inclined with respect to the axial direction.

Further features of the present invention will become apparent from the following description of exemplary embodiments with reference to the attached drawings.

BRIEF DESCRIPTION OF THE DRAWINGS

Parts (a), (b) and (c) of FIG. 1 are schematic views for illustrating a structure of a rotation shaft of a developing roller in Embodiment 1.

Parts (a) and (b) of FIG. 2 are schematic views for illustrating an engagement constitution between the developing roller and a gear in Embodiment 1.

Figure 3:
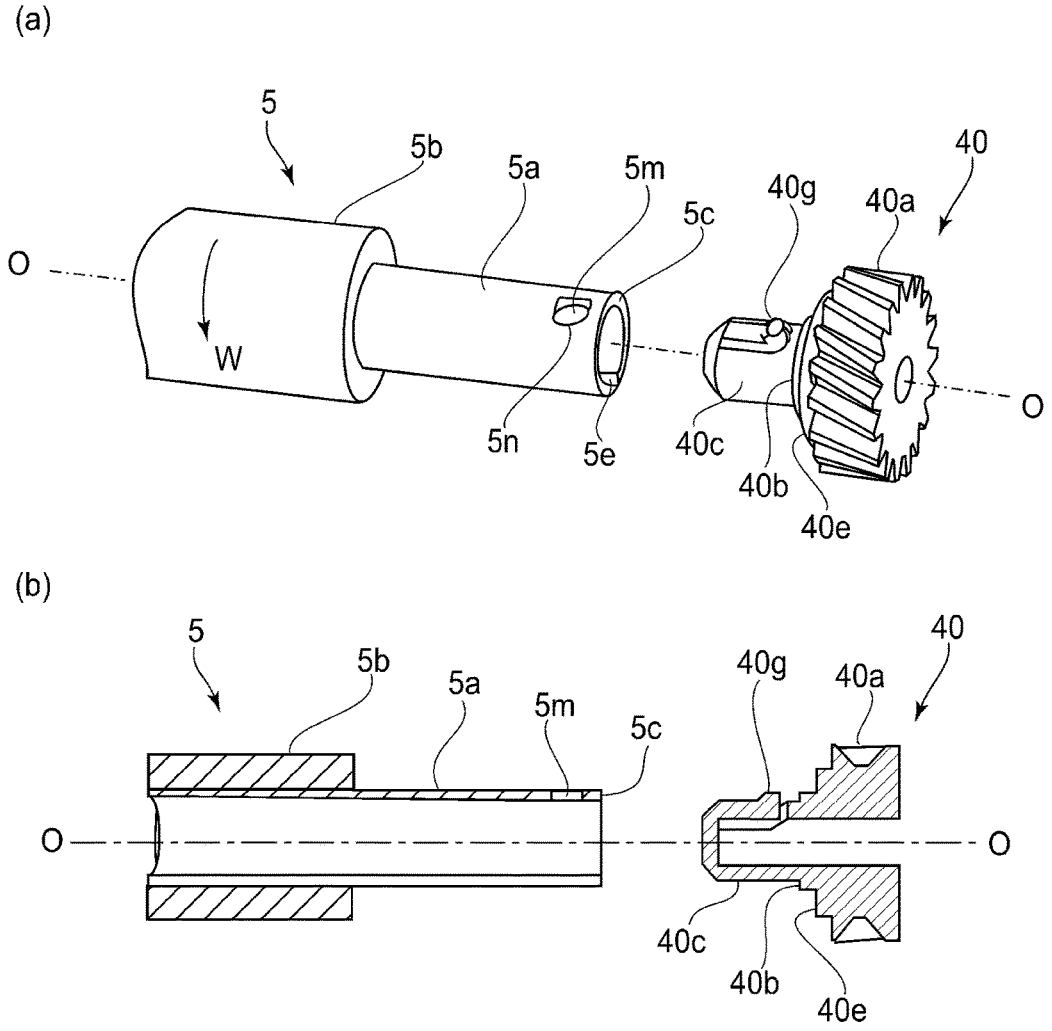

Parts (a) and (b) of FIG. 3 are schematic views for illustrating an engagement constitution between a developing roller and a gear in Embodiment 2.

Figure 4:
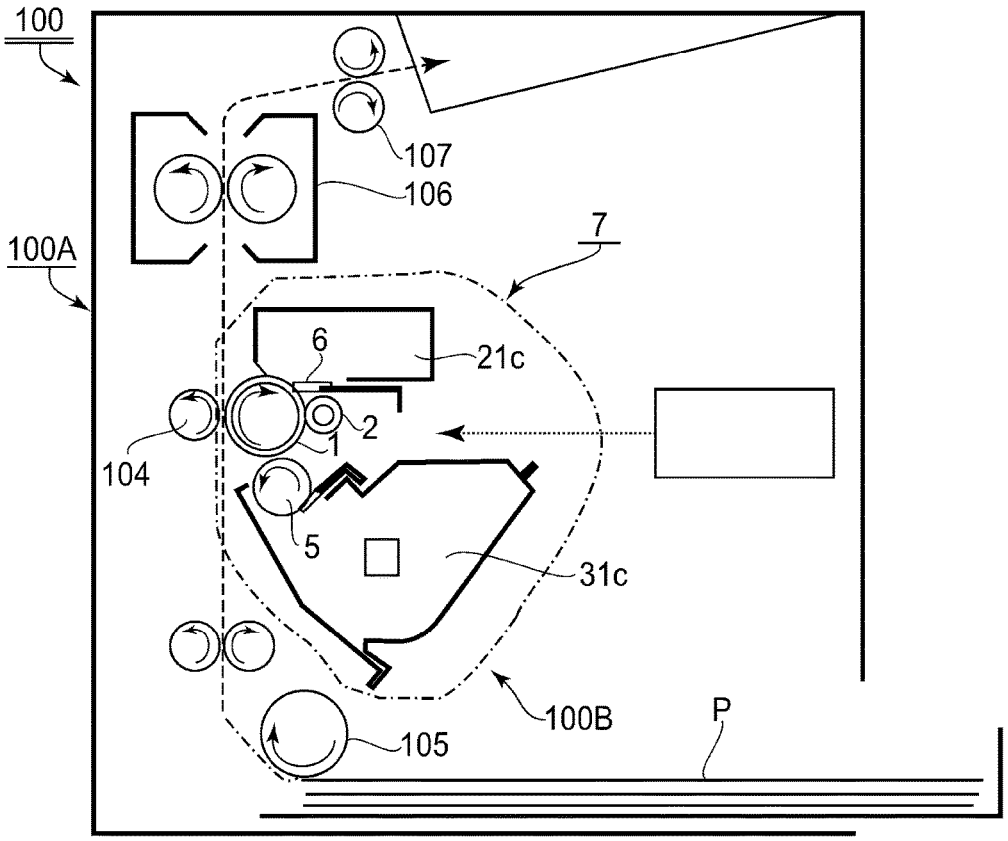

FIG. 4 is a schematic view for illustrating an example of an electrophotographic image forming apparatus.

Figure 5:
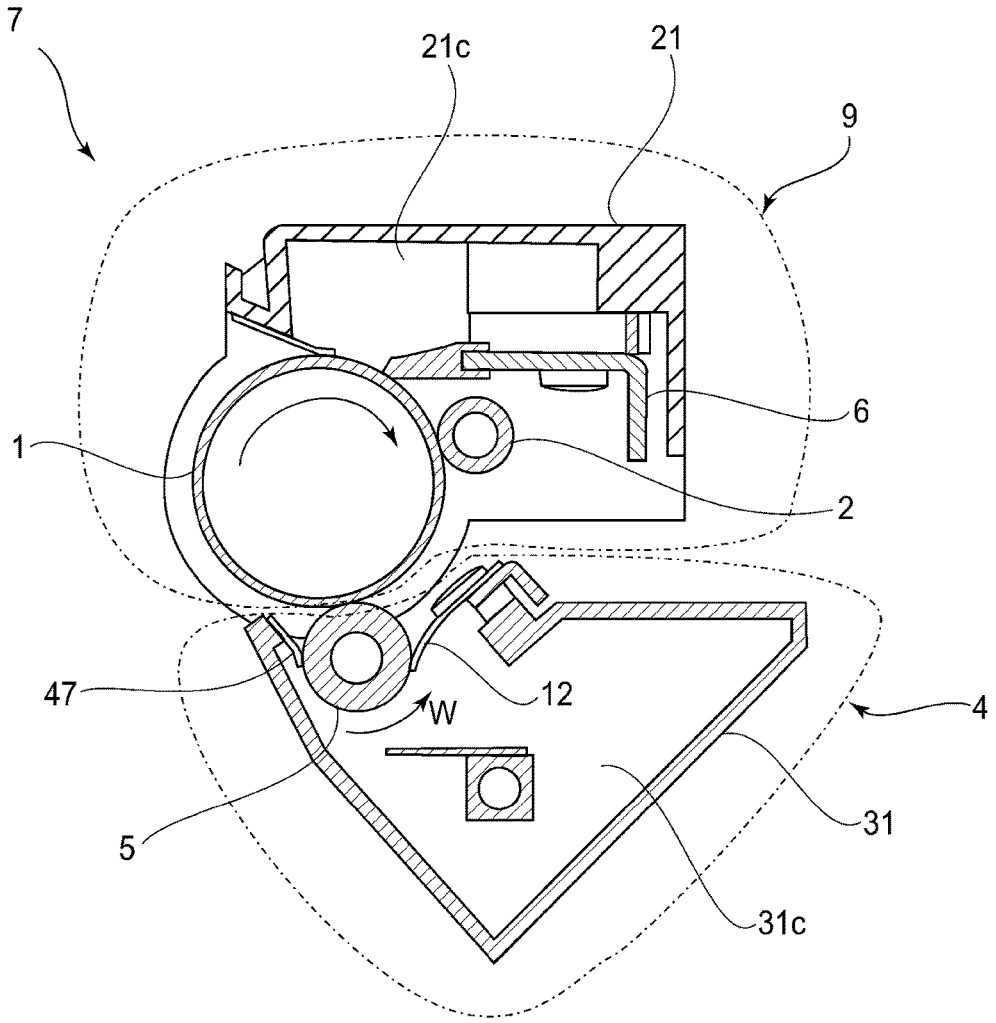

FIG. 5 is a cross-sectional view of a process cartridge.

Figure 6:
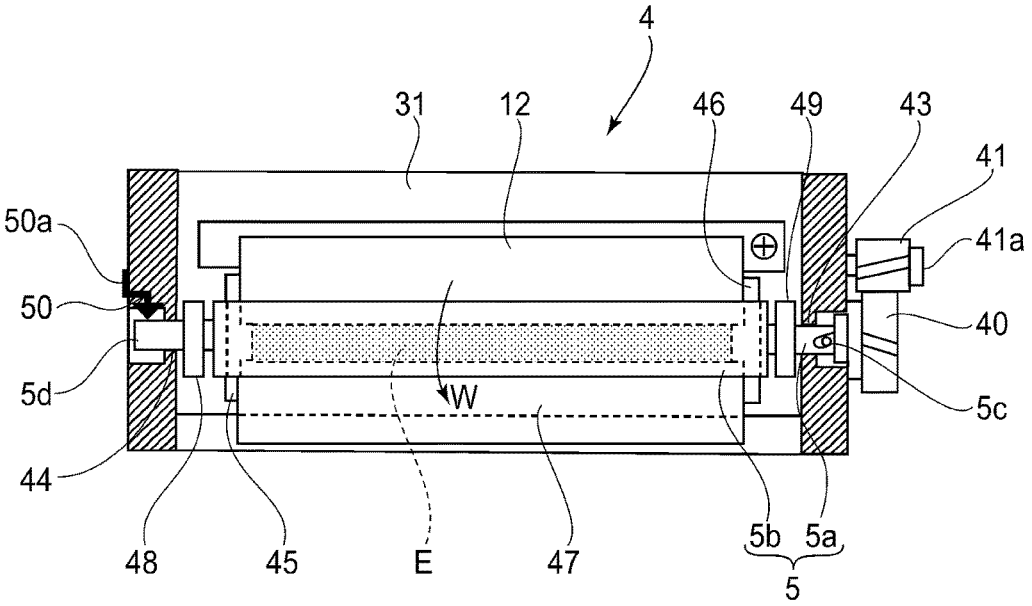

FIG. 6 is a front view of a developing unit.

Figure 7:
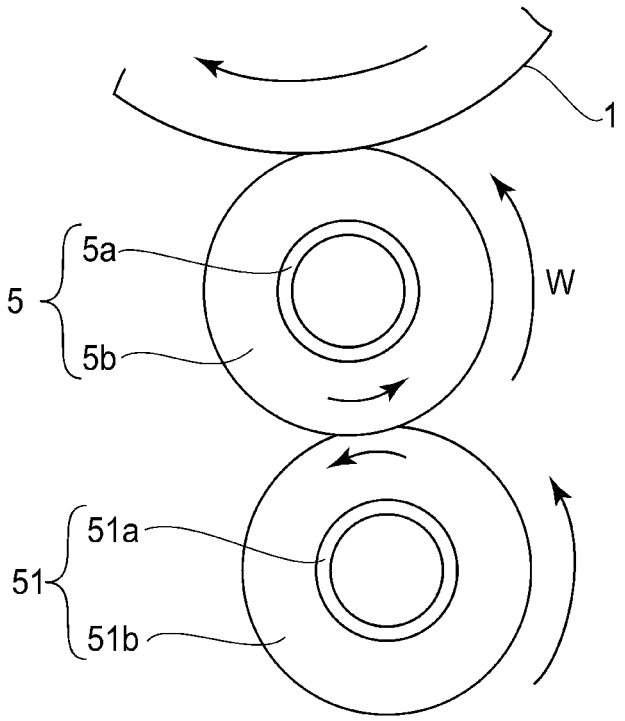
Figure 7:
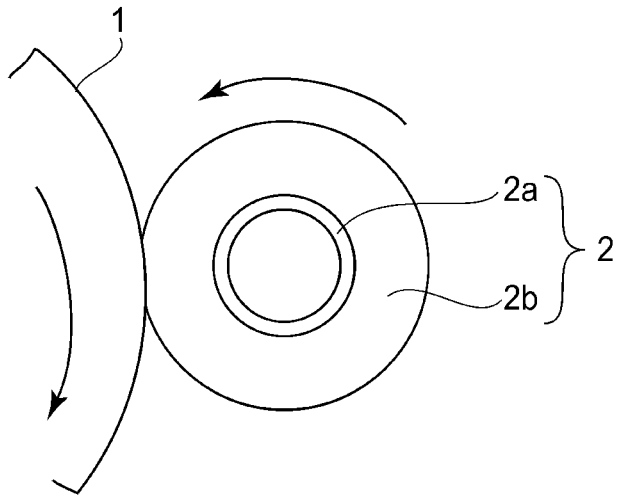

Parts (a) and (b) of FIG. 7 are schematic views for illustrating a developer supplying roller and a charging roller, respectively.

DESCRIPTION OF EMBODIMENTS

Embodiments of the present invention will be described with reference to the drawings. Incidentally, a rotational axis direction (axial direction) of a photosensitive drum refers to as a longitudinal direction.

Embodiment 1

(Structure of Image Forming Apparatus)

FIG. 4 is a schematic structural view showing an electrophotographic image forming apparatus 100 according to an embodiment of the present invention. This image forming apparatus 100 is a printer in which a toner image corresponding to image information inputted from an external host device (not shown) such as a personal computer or an image reader is formed on a transfer (-receiving) material (recording material) which is a recording medium and is printed out.

The image forming apparatus 100 includes a photosensitive drum 1 as an image bearing member rotationally driven. At a periphery of the drum 1, a charging roller 2, an exposure device 102, a developing roller 5, a transfer roller 104 and a cleaning blade 6 are provided. The drum 1, the charging roller 2, the developing roller 5 and the cleaning blade 6 are integrally assembled as a process cartridge 7. The cartridge 7 is detachably mounted to a predetermined mounting portion 100B of an apparatus main assembly 100A in a predetermined operation procedure. That is, the cartridge 7 is a part of the image forming apparatus 100.

In the apparatus main assembly 100A, a fixing device 106, a feeding roller 105 as a feeding means of a transfer material P, and an electrical component substrate (not shown) for carrying out electrical control of the apparatus. The charging roller 2 is rotationally driven in contact with the surface of the photosensitive drum 1 with a predetermined pressing force, and a predetermined charging bias is applied from a charging bias voltage source (not shown) to the charging roller 2, so that the drum 1 is electrically charged to a predetermined polarity and a predetermined potential.

The developing roller 5 is rotationally driven in contact with the surface of the drum 1 with a predetermined pressing force and carries and feeds toner (developer) accommodated in a toner accommodating portion 31*c*, to a developing position which is a contact position with the drum 1, and thus supplies the toner to the photosensitive drum surface. As a result, on an electrostatic latent image formed on the drum 1, the toner is deposited, so that the electrostatic latent image is developed (visualized) as a toner image. To the developing roller 5, a predetermined developing bias is applied from a developing bias voltage source (not shown).

The transfer roller 104 is rotationally driven in contact with the surface of the drum 1 with a predetermined pressing force, and to the transfer roller 104, a predetermined transfer bias is applied from a transfer bias voltage source (not shown). Then, the toner image is transferred from the surface of the drum 1 onto the transfer material P fed to a transfer nip between the transfer roller 104 and the drum 1.

The transfer material P on which the toner image is transferred is fed to the fixing device 106, where predetermined pressure and heat are applied to the transfer material, whereby the toner image is fixed on the transfer material P. Thereafter, the transfer material P is discharged to an outside of the image forming apparatus 100 by a discharging roller pair 107. The cleaning blade 6 removes transfer residual toner remaining on the surface of the drum 1 after the transfer and collects the toner in a residual toner accommodating portion 21*c*. Subsequently, the above-described process is similarly repeated.

(Structure of Process Cartridge)

Next, a structure of the cartridge 7 will be described with reference to FIG. 5 which is a cross-sectional view of the cartridge 7. The cartridge 7 is roughly constituted by a cleaning unit 9 and a developing unit 4. The cartridge 7 is prepared by holding the drum 1, the cleaning blade 9 and the charging roller 2 by a cleaning (unit) frame 21 and by assembling these members into a unit. In the cleaning frame 21, the residual toner accommodating portion 21*c* is formed.

On the other hand, the developing unit 4 is prepared by holding the developing roller 5 and a developing blade 12 by a developing (unit) frame 31 and by assembling these members into a unit. In the developing frame 31, the toner accommodating portion 31*c* is formed. The developing unit 4 is swingably supported by the cleaning unit 9 by supporting portions (not shown) provided at longitudinal end portions. Further, the developing unit 4 is rotationally urged by urging springs (not shown) about the supporting portions in a direction in which the developing roller 5 contacts the drum 1. At one longitudinal end portion of the cartridge 7, a drive inputting portion engaging with a drive imparting portion (not shown) provided in the apparatus main assembly 100A is provided, so that a rotational drive (rotational driving force) is transmitted to the drum 1 and the developing roller 5.

(Structure of Developing Unit)

Next a structure of the developing unit 4 will be described with reference to FIG. 6 which is a front view of the developing unit 4 in a partial transmission state.

The developing roller 5 which is one of the rotatable members has a constitution in which a rotation shaft 5*a* of metal is coated with an elastic layer (elastic material layer) 5*b* at a central portion thereof with respect to an axial direction. The developing roller 5 is rotatably supported at both end portions thereof by shaft supporting portions 43 and 44 provided on the developing frame 31. A gear 40 which is a rotatable driving member for driving the developing roller 5 engages with a one end portion 5*c* projecting further from the shaft supporting portion 43 toward an outside with respect to the axial direction (hereinafter, this portion is referred to as a "first shaft end portion"), and rotates integrally with the developing roller 5. An engaging constitution of the gear 40 with the developing roller 5 will be described later as a feature of the present invention.

The gear 40 engages with an input gear 41. The input gear 41 is provided with a coupling portion 41*a* on a side surface thereof, and the coupling portion 41*a* engages with a drive inputting portion (not shown) provided on the apparatus main assembly 100A side. The elastic layer 5*b* of the developing roller 5 is disposed so as to block an opening E communicating with the toner accommodating portion 31*c* (FIG. 5). The opening Z is sealed with the developing blade 12 and a sealing sheet 47 on two long edge sides and is sealed with sealing members 45 and 46 on two short edge sides.

Outside the sealing members 45 and 46 with respect to the axial direction, rollers 48 and 49 are engaged rotatably about the rotation shaft 5*a*. The rollers 48 and 49 are constituted so that inner diameters thereof are slightly larger than an outer diameter of the rotation shaft 5*a* and so that outer diameters thereof are slightly smaller than an outer diameter of the elastic layer 5*b*. The rollers 48 and 49 urge the drum 1 so that outer peripheral surfaces thereof contact the surface of the drum 1, whereby the developing roller 5 can be kept in a stable contact state with the drum 1.

In the neighborhood of the other end portion 5*d* opposite on side from the first shaft end portion 5*c* of the rotation shaft 5*a* (hereinafter, the other end portion is referred to as a "second shaft end portion"), an electroconductive contact member 50 is provided so as to contact an outer peripheral surface of the rotation shaft 5*a*. The contact member 50 includes a contact portion 50*a* with the apparatus main assembly 100A side, and a bias is applied from the apparatus main assembly 100A side to the developing roller 5 through the contact member 50. Incidentally, the developing roller 5 can also employ a constitution in which the coating layer 5*b* of the rotation shaft 5*a* is a non-elastic material layer.

(Structure of Rotation Shaft 5*a*)

Figure 1:
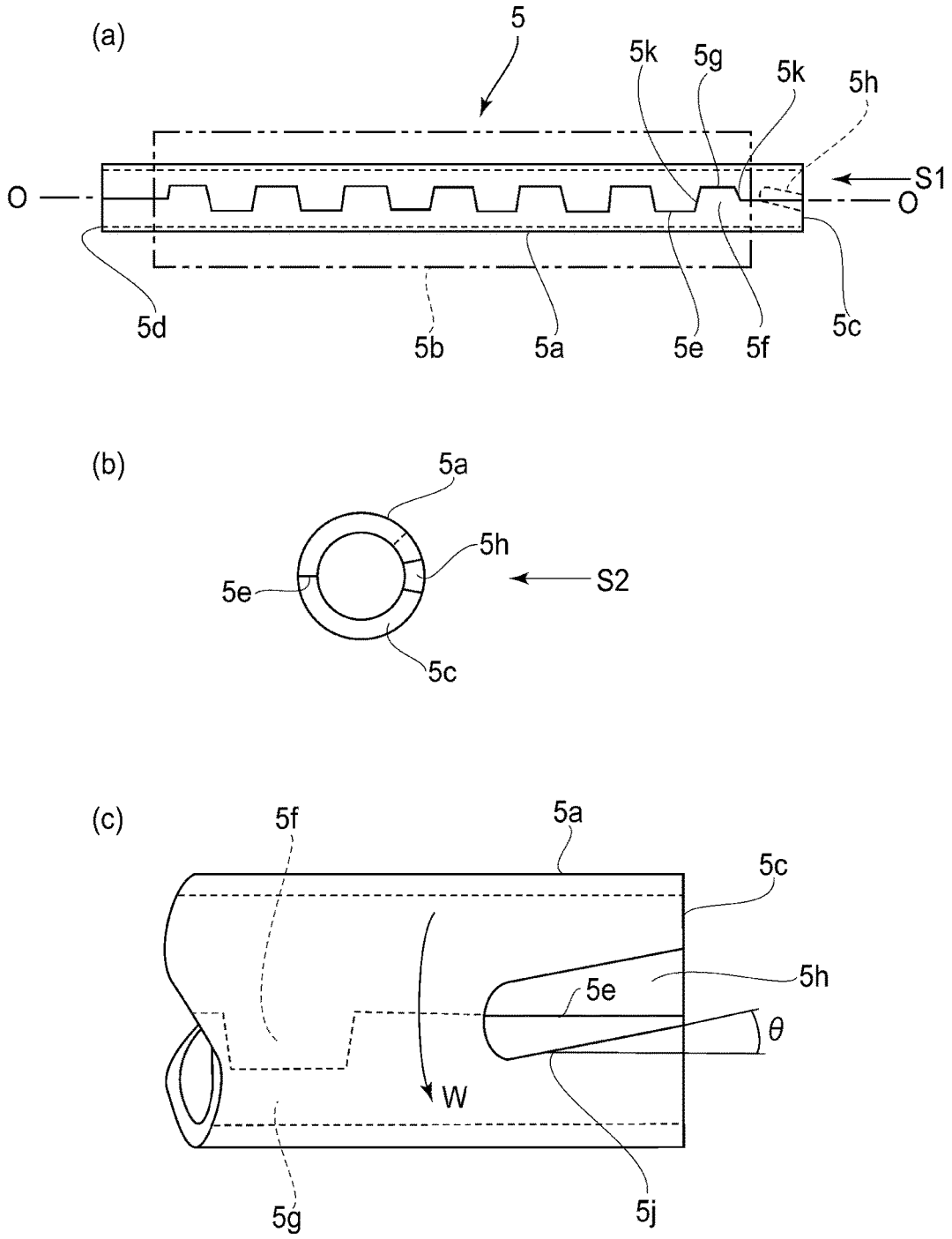

Next, a structure of the rotation shaft 5*a* of the developing roller 5 will be described with reference to FIG. 1. In FIG. 1, part (a) is a front view of the rotation shaft 5*a*, part (b) is a side view of the rotation shaft 5*a* as viewed in an arrow S1 direction in part (a), and part (c) is a rear view of the rotation shaft 5*a* in the neighborhood of the first shaft end portion 5*a* as viewed in an arrow S2 direction in part (b).

The rotation shaft 5*a* has a hollow cylindrical shape including a seam (connecting portion) 5*e* formed by subjecting a rectangular metal plate to press bending and then by bringing end surfaces, extending in the longitudinal direction, of the rectangular metal plate into contact with each other. By employing such a constitution, the rotation shaft 5*a* can be prepared with a lower cost and a lighter weight than those of a solid metal shaft. The rotation shaft 5*a* is provided with circumferentially projected portions 5*f* at one end surface arranged in the longitudinal direction and is provided with circumferentially recessed portions 5*g* at the other end surface, opposing the one end surface, arranged in the longitudinal direction. These projected portions 5*f* and recessed portions 5*g* are engaged with each other by closing a gap 5*k* therebetween with respect to the axial direction. As a result, torsion (twist) strength of the rotation shaft 5*a* can be enhanced. Accordingly, when the rotational drive is imparted to the rotation shaft 5*a*, it is possible to prevent the seam 5*e* from opening.

The structure of the above-described rotation shaft 5*a* is summarized as follows. The rotation shaft 5*a* has the hollow cylindrical shape. The rotation shaft 5*a* includes the seam (connecting portion) 5*e* extending from one end to the other end thereof with respect to an axial direction 0-0 (phantom line). The seam 5*e* is constituted by the recessed portions 5*g* and the projected portions 5*f* which are formed on one side and the other side thereof and is in the form such that he projected portions 5*f* on one side engage with the recessed portions 5*g* on the other side and that the projected portions 5*f* on the other side engage with the recessed portions on one side and thus one side and the other side of the seam 5*e* are connected with each other.

The first shaft end portion 5*c* is a plane perpendicular to an axis 0-0 of the rotation shaft 5*a*. Further, at a part of the first shaft end portion 5*c*, as shown in parts (b) and (c) of FIG. 1, a cut-away portion (recessed portion) 5*h* which penetrating the rectangular metal plate and which has a twisted U-shape is provided. That is, as shown in part (c) of FIG. 1, with respect to the axial direction of the rotation shaft 5*a*, the cut-away portion 5*h* has such a shape as to be recessed from a longitudinal end of the first shaft end portion 5*c* toward a central portion of the rotation shaft 5*a*. With respect to a circumferential direction (W direction), a phase in which the cut-away portion 5*h* is provided is opposite from a phase in which the seam 5*e* is provided. That is, the cut-away portion 5*h* is disposed opposed to the seam 5*e* with respect to the axis 0-0 of the rotation shaft 5*a*. As is apparent from part (b) of FIG. 1 and part (a) of FIG. 2, the rectangular metal plate forming the rotation shaft 5*a* has a predetermined thickness, and therefore, when the cut-away portion 5*h* penetrating the rectangular metal plate is provided, the cut-away portion 5*h* includes an end surface corresponding to a thickness of the rectangular metal plate.

A twist direction of the cut-away portion 5*h* is determined by the rotational direction of the rotation shaft 5*a*. In this embodiment, as shown in part (c) of FIG. 1, in the case where the rotation shaft 5*a* is rotated from above toward below in the axis W direction, the cut-away portion 5*h* has such a shape that the cut-away portion 5*h* is twisted toward a downstream side with respect to the rotational direction (i.e., twisted downwardly in the figure) with an increasing distance from the first shaft end portion 5*c* toward the second shaft end portion 5*d*. The cut-away portion 5*h* can be prepared inexpensively by being punched simultaneously when the metal plate is stamped into a rectangular shape.

(Engagement Constitution (Structure) Between Developing Roller 5 and Gear 40)

Figure 2:
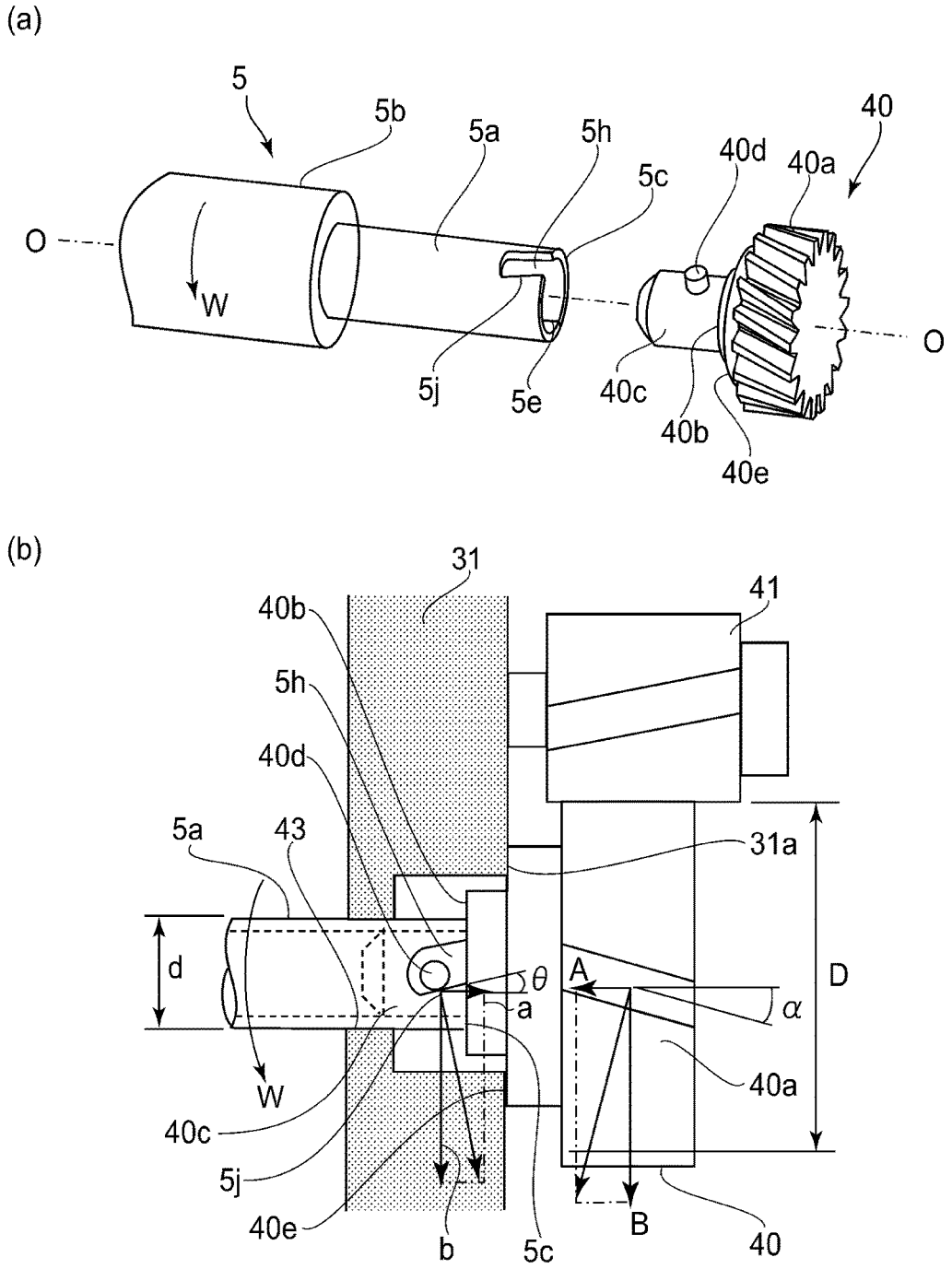

Next, the engagement constitution between the developing roller 5 and the gear 40 will be described with reference to FIG. 2. In FIG. 2, part (a) is a perspective view showing a state of the developing roller 5 and the gear 40 before engagement, and part (b) is a partial front view of the developing roller 5 and the gear 40 in a partial transmission state. The gear 40 includes a positioning portion 40*b* constituted by a flat surface perpendicular to the axis 0-0. The positioning portion 40*b* contacts the first shaft end portion 5*c* of the rotation shaft 5*a* and determines a position of the gear 40 relative to the rotation shaft 5*a* in contact with the first shaft end portion 5*c* of the rotation shaft 5*a*.

Further, the gear 40 includes a shaft centering portion 40*c* having the same diameter as an inner diameter of the rotation shaft 5*a*. The shaft centering portion 40*c* engages with an inner peripheral surface of the rotation shaft 5*a* and determines the position of the rotation shaft 5*a* so that an axial center thereof aligns (overlaps) with the rotation shaft 5*a*. Further, the gear 40 includes a regulating surface 40*e*, and the regulating surface 40*e* contacts a regulating surface 31*a* of the developing frame 31, so that a position of the gear 40 relative to the developing frame 31 with respect to the axial direction is regulated.

Further, the gear 40 includes, on an outer peripheral surface of the shaft centering portion 40*c*, a gear portion 40*a* which is a drive receiving portion for receiving rotational drive from the apparatus main assembly 100A and a boss 40*d* perpendicular to the axis of the shaft centering portion 40*c*. In a state in which the gear 40 is engaged with the rotation shaft 5*a*, when the rotational drive is imparted from the gear portion 40*a* to the rotation shaft 5*a*, the rotational drive is transmitted to the rotation shaft 5*a* through the boss 40*d*. That is, the boss 40*d* acts as a drive transmitting portion.

Then, a manner of drive transmission will be described with reference to part (b) of FIG. 2. The gear 40 receives the drive (driving force) from the input gear 41 and is rotated in the arrow W direction in the figure. In this embodiment, the gear portion 40*a* is a helical gear, and a clockwise helix angle $\alpha$ is provided so that when the gear portion 40*a* receives the drive, an axial directional force A generates in a direction (from right to left in the figure) in which the gear portion 40*a* is drawn into the developing frame 31. By the axial directional force A, the regulating surface 40*e* of the gear 40 contacts the regulating surface 31*a* of the developing frame 31.

When the gear 40 is rotated, the boss 40*d* contacts an end surface 5*j* which is a part of the end surface of the cut-away portion 5*h* and which is provided on a downstream side with respect to the rotational direction W (hereinafter, the end surface 5*j* is referred to as a drive transmitting portion), so that the rotational drive is transmitted to the developing roller 5. That is, the rotation shaft 5*a* includes the drive transmitting portion 5*j*; for receiving the rotational drive, in the neighborhood of the first shaft end portion 5*c* which is one end thereof. The drive transmitting portion 5*j* is provided as the end surface 5*j* twisted or inclined toward the downstream side with respect to the rotational direction W of the developing roller 5 with an increasing distance from the first shaft end portion 5*c* toward the second shaft end portion 5*d* which is the other end. That is, the end surface 5*j* is a surface twisted or inclined with respect to the axial direction of the rotation shaft 5*a*.

As described above, the rotation shaft 5*a* is provided so as to close the gap 5*k* between the projected portions 5*f* and the recessed portions 5*g* with respect to the axial direction, and therefore, even in the case where the drive is transmitted to the rotation shaft 5*a*, an increase in gap between the shaft centering portion 40*c* and the inner peripheral surface of the rotation shaft 5*a* is suppressed. As a result, a rotational fluctuation due to eccentricity is suppressed.

In the case where a load torque of the developing roller 5 is T and a pitch circle diameter of the gear portion 40*a* is D, at an engaging portion between the gear portion 40*a* and the input gear 41, a component force (component of force) A exerted on the gear portion 40*a* in the axial direction and a component force B in a circumferential direction are represented by the following formulas.

$$A=B\tan\alpha \quad (1)$$

$$B=2T/D \quad (2)$$

On the other hand, the rotation shaft 5*a* receives a force from the boss 40*d* at the drive transmitting portion 5*j*. When an outer diameter of the rotation shaft 5*a* is d and a helix angle of the drive transmitting portion 5*j* is θ, a component force a, in the axial direction, of a force by the boss 40*d* and a component force b in the circumferential direction are represented by the following formulas.

$$a=b\tan\theta \quad (3)$$

$$b=2T/d \quad (4)$$

Thus, when the drive is transmitted to the rotation shaft 5*a*, on the developing roller 5, the component force a in the axial direction acts in a direction in which the developing roller 5 is drawn to the gear 40. Then, the first shaft end portion 5*c* of the developing roller 5 contacts the positioning portion 40*b*, so that the position of the developing roller 5 relative to the gear 40 with respect to the axial direction is determined.

Further, on the gear 40, the component force A exerted by the input gear 41 in the axial direction and the reaction force a exerted by the developing roller 5 in the axial direction act. Both the forces act in a direction in which the gear 40 is drawn into the developing frame 31. As a result, the regulating surface 40*e* of the gear 40 contacts the regulating surface 31*a*, so that the position of the gear 40 relative to the developing frame 31 with respect to the axial direction is determined.

From the above-described relationships, the position of the developing roller 5 relative to the developing frame 31 with respect to the axial direction is determined through the gear 40. Further, when such a constitution is employed, the developing roller 5 can be rotated without bringing the second shaft end portion 5*d* into contact with the developing frame 31, so that rotation accuracy is not influenced even when an uneven portion such as a press work trace is formed on the second shaft end portion 5*d*. Accordingly, there is no need to smoothly process the second shaft end portion 5*d* after the press work, and therefore, the developing roller 5 can be manufactured inexpensively. Further, the rotation shaft 5*a* and the gear 40 attract each other during rotation so as not to loosened, and therefore, it is possible to suppress a rotational fluctuation and a positional fluctuation of the developing roller 5.

Incidentally, in this embodiment, even when the boss 40*d* which is a drive imparting portion and the drive transmitting portion 5*j* are disposed in any phases and even when these portions are provided in plural pairs, a similar effect can be obtained.

Also a constitution in which a so-called developer supplying roller not only supplying the toner from the toner accommodating portion 31*c* to the developing roller 5 but also peeling excessive toner off the developing roller 5 at the same time is provided depending on the process cartridge and is slid on and driven by the developing roller 5 has been known in general.

In part (a) of FIG. 7, 51 represents the developer supplying roller and includes an elastic material layer 51 (or a non-elastic material layer) coating a rotation shaft 51*a*, and supplies the toner (developer) to the developing roller 5 for supplying the toner to the drum 1. The developer supplying roller 51 is contacted to the developing roller 5 and is rotationally driven at a contact portion with the developing roller 5 in a direction opposite to the rotational direction W of the developing roller 5, and not only supplies the toner to the developing roller 5 but also peels the excessive toner off the developing roller 5 at the same time.

In this embodiment, the present invention is applied to the rotation shaft 5*a* of the developing roller 5 which is one of the rotatable members, but is also similarly applicable to the rotation shaft 51*a* of the developer supplying roller 51. Similarly as in the case of the developing roller 5, an effect of suppressing a rotational fluctuation and a positional fluctuation of the developer supplying roller 51 can be obtained.

Further, also the charging roller 2, a rotation shaft structure similar to that of the developing roller 5 in this embodiment and a structure for driving the developing roller are applicable. Also the charging roller 2 includes, as shown in part (b) of FIG. 7, a rotation shaft 2*a* and an elastic material layer (or non-elastic material layer) 2*b* coating the rotation shaft 2*a* and electrically charges the drum 1 in contact with the drum 1. By driving the charging roller 2 with a peripheral speed difference between itself and the photosensitive member 1, an effect of removing a contamination, such as paper powder, deposited on the charging roller surface is achieved, but by employing the constitution in this embodiment, an effect of suppressing the rotational fluctuation and the positional fluctuation is achieved, and therefore, the contamination can be uniformly removed. As a result, charging non-uniformity of the drum 1 can be suppressed.

Embodiment 2

A constitution according to Embodiment 2 will be described with reference to FIG. 3. In FIG. 3, part (a) is a perspective view showing a state before engagement between a developing roller 5 and a gear 40, and part (b) is a sectional view of the gear 40.

The developing roller 5 includes a rotation shaft 5*a* having a circumferentially twisted end surface 5*n* in the neighborhood of a first shaft end portion 5*c* and provided with a hole 5*m* penetrating a rectangular metal plate. As is apparent from part (a) of FIG. 3, the rectangular metal plate has a predetermined thickness, and therefore, when the hole 5*m* penetrating the rectangular metal plate is formed, the hole 5*m* is provided with an end surface corresponding to the thickness of the rectangular metal plate. A part of the end surface is the end surface 5*n*. A fracture surface of the end surface 5*n* has such a shape that the fracture surface is twisted toward a downstream side with respect to the rotational direction (i.e., twisted downwardly in the figure) with an increasing distance from the first shaft end portion 5*c* toward the second shaft end portion 5*d*. As is apparent from part (a) of FIG. 3, similarly as in Embodiment 1, with respect to the circumferential direction (W direction), a phase in which the hole 5*m* is provided is opposite from a phase in which the seam 5*e* is provided. That is, the hole 5*m* is disposed opposed to the seam 5*e* with respect to the axis 0-0. Further, as is apparent from part (a) of FIG. 3, the hole 5*m* penetrates the rotation shaft 5*a* from an outside to a hollow portion (communicates the outside of the rotation shaft 5*a* with the hollow portion of the rotation shaft 5*a*) with respect to a direction crossing the axis 0-0.

Further, as a drive imparting portion to the rotation shaft 5*a*, a snap-fitting portion 40*g* is provided on an outer peripheral surface of a shaft centering portion 40*c* so as to be perpendicular to an axis of the shaft centering portion 40*c*. When the gear 40 in engaged with the rotation shaft 5*a*, the shaft centering portion 40*c* is inserted into the first shaft end portion 5*c* while flexing the snap-fitting portion 40*g*, so that the snap-fitting portion 40*g* and the hole 5*m* are engaged with each other. In that state, when the rotational drive in the arrow W direction is imparted to the gear 40, the snap-fitting portion 40*g* contacts the fracture surface 5*n* (drive transmitting portion).

By the above-described constitution, similarly as in Embodiment 1, the rotation shaft 5*a* and the gear 40 can be fastened to each other without being loosened during the drive, and therefore, a rotational fluctuation and a positional fluctuation of the developing roller 5 can be suppressed. Further, the drive transmitting portion 5*n* is provided at the end surface defining the hole 5*m*, so that a true circle in the neighborhood of the first shaft end portion 5*c* can be formed with high accuracy. Further, helix (twist) strength of the rotation shaft 5*a* in the neighborhood of the hole 5*m* can be further enhanced. Further, similarly as the constitution described in Embodiment 1, the constitution in this embodiment is also applicable to the developer supplying roller 51 and the charging roller 2. Further, the end surface 5*j* in Embodiment 1 and the end surface 5*n* in this embodiment (Embodiment 2) were transmitting surfaces for transmitting thereto (or receiving) a driving force, for rotating the rotation shaft 5*a* about the axis, from the boss 40*d* or the snap-fitting portion 40*g* of the gear 40. However, the constitutions of Embodiments 1 and 2 are also applicable to an embodiment in which the drive transmitting direction is opposite to that in Embodiments 1 and 2. In this case, the end surface 5*j* and the end surface 5*n* are transmitting surfaces for transmitting the driving force to the boss 40*d* or the snap-fitting portion 40*g* in order to rotate the gear 40 by the driving force from the rotation shaft 5*a*. Further, the rotation shafts 5*a* and the supporting structures and the drive transmitting structures of the rotation shafts 5*a* in Embodiments 1 and 2 are applicable to a structure of the apparatus main assembly 100A and a structure of the electrophotographic image forming apparatus, not the process cartridge 7. For example, the structures are applicable to a feeding mechanism for feeding a sheet on which the toner image is to be transferred, a transferring mechanism for transferring the toner image onto the sheet or an intermediary transfer belt, a fixing mechanism for fixing the toner image on the sheet under application of heat and/or pressure to the sheet on which the toner image is transferred, and the like mechanism.

Here, the electrophotographic image forming apparatus also includes an image forming apparatus of a transfer type or a direct type, in which a latent image, such as an electrostatic latent image, a magnetic latent image or a resistance pattern latent image, is formed using an electrostatic recording dielectric member or a magnetic recording (magnetic) material as the image bearing member and is developed with the developer. Also in this case, such an image forming apparatus is referred to as the electrophotographic image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-076570 filed on Apr. 7, 2017, which is hereby incorporated by reference herein in its entirety.

What is claimed is:

1. A rotatable member for use with a rotatable driving member provided in a process cartridge or an electrophotographic image forming apparatus, said rotatable member comprising:

a hollow cylindrical rotation shaft engageable with the rotatable driving member, wherein said rotation shaft includes a seam extending from one end to the other end thereof in an axial direction thereof, wherein said rotation shaft includes a transmitting surface engaging with the driving member and configured to receive a driving force for rotating said rotation shaft about the axial direction, and wherein said transmitting surface is twisted or inclined with respect to the axial direction.

2. A rotatable member according to claim 1, wherein said rotation shaft includes a recessed portion recessed from an end portion toward a central portion with respect to the axial direction, and said transmitting surface is provided at an end portion of said recessed portion.

3. A rotatable member according to claim 2, wherein said recessed portion is provided at a position opposing said seam with respect to an axis of said rotation shaft.

4. A rotatable member according to claim 1, further comprising a hole communicating an outside and a hollow portion, wherein said transmitting surface is provided at an edge portion of said hole.

5. A rotatable member according to claim 4, wherein said recessed portion is provided at a position opposing said seam with respect to an axis of said rotation shaft.

6. A rotatable member according to claim 1, wherein said seam is constituted by a recessed portion and a projected portion which are connected with each other between one side and the other side of said seam by engagement of said projected portion on said one side with said recessed portion on said the other side and by engagement of said projected portion on said the other side with said recessed portion on said one side.

7. A rotatable member according to claim 1, further comprising an elastic material layer or a non-elastic material layer coating said rotation shaft, wherein said rotatable member is a developing roller for supplying a developer to an image bearing member.

8. A rotatable member according to claim 1, further comprising an elastic material layer or a non-elastic material layer coating said rotation shaft, wherein said rotatable member is a developer supplying roller for supplying a developing roller for supplying the developer to an image bearing member.

9. A rotatable member according to claim 1, further comprising an elastic material layer or a non-elastic material layer coating said rotation shaft, wherein said rotatable member is a charging roller for electrically charging an image bearing member in contact with the image bearing member.

10. A rotatable member for use with a rotatable driving member provided in a process cartridge or an electrophotographic image forming apparatus, said rotatable member comprising:

a hollow cylindrical rotation shaft engageable with the rotatable driving member, wherein said rotation shaft includes a seam extending from one end to the other end thereof in an axial direction thereof, wherein said rotation shaft includes a transmitting surface engaging with the driving member and configured to transmit a driving force to the driving member, and wherein said transmitting surface is twisted or inclined with respect to the axial direction.

11. A rotatable member according to claim 10, wherein said rotation shaft includes a recessed portion recessed from an end portion toward a central portion with respect to the axial direction, and said transmitting surface is provided at an end portion of said recessed portion.

12. A rotatable member according to claim 11, wherein said recessed portion is provided at a position opposing said seam with respect to an axis of said rotation shaft.

13. A rotatable member according to claim 10, further comprising a hole communicating an outside and a hollow portion, wherein said transmitting surface is provided at an edge portion of said hole.

14. A rotatable member according to claim 13, wherein said recessed portion is provided at a position opposing said seam with respect to an axis of said rotation shaft.

15. A rotatable member according to claim 10, wherein said seam is constituted by a recessed portion and a projected portion which are connected with each other between one side and the other side of said seam by engagement of said projected portion on said one side with said recessed portion on said the other side and by engagement of said projected portion on said the other side with said recessed portion on said one side.

16. A rotatable member according to claim 10, further comprising an elastic material layer or a non-elastic material layer coating said rotation shaft, wherein said rotatable member is a developing roller for supplying a developer to an image bearing member.

17. A rotatable member according to claim 10, further comprising an elastic material layer or a non-elastic material layer coating said rotation shaft, wherein said rotatable member is a developer supplying roller for supplying a developing roller for supplying the developer to an image bearing member.

18. A rotatable member according to claim 10, further comprising an elastic material layer or a non-elastic material layer coating said rotation shaft, wherein said rotatable member is a charging roller for electrically charging an image bearing member in contact with the image bearing member.

19. An electrophotographic image forming apparatus comprising:

a rotatable member including hollow cylindrical rotation shaft;

a supporting member rotatably supporting said rotatable member;

a rotatable driving member engaging with said rotation shaft; and a regulating surface contacting said driving member and regulating a position of said driving member with respect to an axial direction of said rotation shaft, wherein said rotation shaft includes a seam extending from one end to the other end thereof in an axial direction thereof, wherein said rotation shaft includes a transmitting surface engaging with said driving member and configured to receive a driving force for rotating said rotation shaft about the axial direction, wherein said transmitting surface is twisted or inclined with respect to the axial direction, and wherein during rotation of said rotatable member, the position of said driving member with respect to the axial direction of said rotation shaft by contact of said driving member with said regulating surface.

20. An electrophotographic image forming apparatus comprising:

a rotatable member including hollow cylindrical rotation shaft;

a supporting member rotatably supporting said rotatable member;

a rotatable driving member engaging with said rotation shaft; and a regulating surface contacting said driving member and regulating a position of said driving member with respect to an axial direction of said rotation shaft, wherein said rotation shaft includes a seam extending from one end to the other end thereof in an axial direction thereof, wherein said rotation shaft includes a transmitting surface engaging with said driving member and configured to transmit a driving force to said driving member, wherein said transmitting surface is twisted or inclined with respect to the axial direction, and wherein during rotation of said rotatable member, the position of said driving member with respect to the axial direction of said rotation shaft by contact of said driving member with said regulating surface.

* * * * *